US009401236B2

(12) United States Patent
Maier

(10) Patent No.: US 9,401,236 B2
(45) Date of Patent: Jul. 26, 2016

(54) MAGNETIC ACTUATOR

(75) Inventor: Dieter Maier, Rettenberg (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 13/810,764

(22) PCT Filed: Jun. 14, 2011

(86) PCT No.: PCT/EP2011/059803
§ 371 (c)(1),
(2), (4) Date: Mar. 26, 2013

(87) PCT Pub. No.: WO2012/019807
PCT Pub. Date: Feb. 16, 2012

(65) Prior Publication Data

US 2013/0207756 A1 Aug. 15, 2013

(30) Foreign Application Priority Data

Jul. 27, 2010 (DE) ..... 10 2010 038 437

(51) Int. Cl.

| | |
|---|---|
| ***H01F 7/11*** | (2006.01) |
| ***H01F 3/08*** | (2006.01) |
| ***B22F 3/22*** | (2006.01) |
| ***F02M 51/06*** | (2006.01) |

(Continued)

(52) U.S. Cl.
CPC *H01F 3/08* (2013.01); *B22F 3/225* (2013.01); *F02M 51/0614* (2013.01); *F02M 51/0685* (2013.01); *F02M 61/168* (2013.01); *H01F 7/081* (2013.01); *H01F 7/11* (2013.01); *H01F 41/0246* (2013.01); *F02M 2200/8046* (2013.01); *H01F 2007/1676* (2013.01)

(58) Field of Classification Search
CPC ..... H01F 7/11; H01F 7/081
USPC ..... 335/243, 281
See application file for complete search history.

(56) References Cited

U.S. PATENT DOCUMENTS 2,903,610 A * 9/1959 Bessiere ..... 310/216.066
5,687,468 A 11/1997 Hans et al.

(Continued)

FOREIGN PATENT DOCUMENTS

CN 101072942 A 11/2007
CN 102667131 A 9/2009

(Continued)

OTHER PUBLICATIONS

Dutra, et al., "Thermodynamic Simulation of 316L and 17-4PH Stainless Steels Using Different Process Conditions for Two Components Metal Injection Moulding (2C-MIM)," Euro PM2009—Powder Injection Moulding—Compounds & Composite Parts.*

(Continued)

*Primary Examiner* — Ramon M Barrera
(74) *Attorney, Agent, or Firm* — Norton Rose Fulbright US LLP

(57) ABSTRACT

Magnetic actuator includes a pole body having at least one magnetic region and at least one nonmagnetic region, the nonmagnetic region providing a magnetic isolation of the magnetic region. The pole body is developed as a one-piece component, and the magnetic regions and the nonmagnetic regions of the pole body are connected in a continuous material manner, using a two-component metal powder injection molding process.

37 Claims, 2 Drawing Sheets

(51) Int. Cl.

| | |
|---|---|
| ***F02M 61/16*** | (2006.01) |
| ***H01F 7/08*** | (2006.01) |
| ***H01F 41/02*** | (2006.01) |
| *H01F 7/16* | (2006.01) |

(56) References Cited

U.S. PATENT DOCUMENTS

| | | | |
|---|---|---|---|
| 2003/0062660 | A1 | 4/2003 | Beard et al. |
| 2004/0118952 | A1 | 6/2004 | Nussio |

FOREIGN PATENT DOCUMENTS

| | | | |
|---|---|---|---|
| DE | 196 39 117 | | 3/1998 |
| DE | 10 2005 052 252 | | 5/2007 |
| JP | 2-40969 | | 2/1990 |
| JP | 3-122514 | | 12/1991 |
| JP | 5-83361 | | 11/1993 |
| JP | 6-26418 | | 2/1994 |
| JP | 6-81976 | | 3/1994 |
| JP | 7-504008 | | 4/1995 |
| JP | 2001148308 | | 5/2001 |
| JP | 2005-1570 | | 1/2005 |
| JP | 2005 089 777 | | 4/2005 |
| JP | 2005311248 | A | 11/2005 |
| JP | 2013513226 | A | 4/2013 |
| WO | 2010007153 | A2 | 1/2010 |
| WO | WO 2011/067 021 | | 6/2011 |
| WO | WO 2011/076 535 | | 6/2011 |

OTHER PUBLICATIONS

International Search Report for PCT/EP2011/059803, dated Nov. 29, 2011.

* cited by examiner

MAGNETIC ACTUATOR

BACKGROUND OF THE INVENTION

1. Field of the Invention

The present invention relates to a magnetic actuator for a fuel injector as well as a method for producing a pole body for the magnetic actuator.

2. Description of the Related Art

Fuel injectors of the related art are essentially designed as magnetic switching valves having a coil and a magnetic actuator, whose pole body is developed of several sectors having a ferritic, magnetic material which are electrically insulated from one another by a surface layer. Such a magnetic switching valve is known from the published German patent application document DE 196 39 117 A1, for example. Because of the thin surface layer and the contour of the pole body, during an increase and a decrease in the magnetic field during operation, eddy current losses may take place and as a result, a lessening of the switching time or dynamics of the fuel injector. In addition, the manufacturing of the composed pole body in a plurality of process steps is very costly.

BRIEF SUMMARY OF THE INVENTION

By contrast, the magnetic actuator according to the present invention has the advantage that in this case a magnetic actuator is provided which has an effectively eddy current minimized magnetic circuit, and therefore makes possible clearly reduced switching times of the valve. According to the present invention, this is achieved in that the magnetic actuator includes a pole body which is developed as a one piece component having at least one magnetic region and at least one nonmagnetic region. The nonmagnetic region makes possible, in this instance, a magnetic isolation between the magnetic and the nonmagnetic region a continuous material connection being present that uses a two-component metal powder injection molding process. Consequently, the production of the one piece pole body of the magnetic actuator may be implemented in one process step, at low clock pulse times and per piece costs, in a simple manner as a mass-produced item.

The pole body preferably has at least two magnetic regions and at least two nonmagnetic regions which are situated alternatingly in a circumferential direction of the pole body. The magnetic regions are thereby isolated from one another by the nonmagnetic regions, the magnetic regions and the nonmagnetic regions of the pole body being connected by a continuous material using a two-component metal powder injection molding process.

Two lateral surfaces of the nonmagnetic regions of the pole body are preferably parallel to each other, whereby the magnetic actuator achieves particularly high dynamics. One width of the nonmagnetic region is selected to be so big, in this instance, that electric isolation of adjacent magnetic regions is achieved. A sector area of the nonmagnetic regions is clearly smaller than those of the magnetic regions, preferably by a factor of 4 to 6, particularly by a factor of 5.

Furthermore, the pole body preferably has a flange that runs radially outwards. According to one additional preferred embodiment, a lead-through for an electrical contacting is situated in the flange. This makes possible a short cable duct completely inside the valve housing, which ensures an electrical contacting of the magnetic actuator that is operationally reliable. Moreover, using the two-component metal powder injection molding process, the coil housing is also able to be produced simultaneously in one manufacturing step.

The pole body preferably has a coil housing running in the axial direction, so that a coil is situated in the radial direction between the coil housing and the pole body. A compact design of the magnetic actuator is thereby implemented, which contributes to a minimized installation volume of the entire fuel-injection system.

An axial extension of the pole body greater than an axial extension of the coil housing is also preferred. Because of this, the end facing the injection side is fixed in a simple and cost-effective manner to the valve housing, while the end of the pole body facing away from the injection side is supported on the inside of the valve housing. Consequently, a rapid production is possible having a small number of assembly steps.

According to an additional preferred refinement, the pole body has a central feed-through opening. This ensures an operationally reliable guidance of a valve needle arranged in it including a return spring and a sleeve.

The pole body preferably has an even number of magnetic regions, particularly four magnetic regions, and an even number of nonmagnetic regions, particularly four nonmagnetic regions. Further preferred, the pole body has a symmetrical design. Because of this, even because of a small number of magnetic and nonmagnetic regions, a drastic reduction of eddy current losses is achieved during magnetic field changes in the operation of the magnetic actuator. In addition, the pole body thereby has a simple and cost-effectively producible design.

Furthermore, the present invention relates to a method for producing a one-piece pole body for a magnetic actuator, including the following steps: providing a magnetic and a nonmagnetic material, and producing nonmagnetic regions and magnetic regions of the pole body, using a two-component metal powder injection molding process for producing continuous material connections between the magnetic and the nonmagnetic regions. Because of the method according to the present invention, the production of the one piece pole body is able to take place at high reproducibility, so that a magnetic actuator is provided which drastically reduces the switching times of the fuel injector, whereby, when it is used e.g. in a motor vehicle, a clearly lower fuel quantity has to be injected into the combustion chamber. Because of the reduced injected quantity, the idle behavior of the engine is improved. This leads to a clearly improved emission behavior. Furthermore, the method is also usable for producing complex components at various sizes, in a most economic fashion.

DETAILED DESCRIPTION OF THE INVENTION

In the following text, a magnetic actuator according to one preferred exemplary embodiment of the present invention, and a method for producing a pole body of the magnetic actuator are described in detail with reference to FIGS. 1 and 2.

Figure 1:
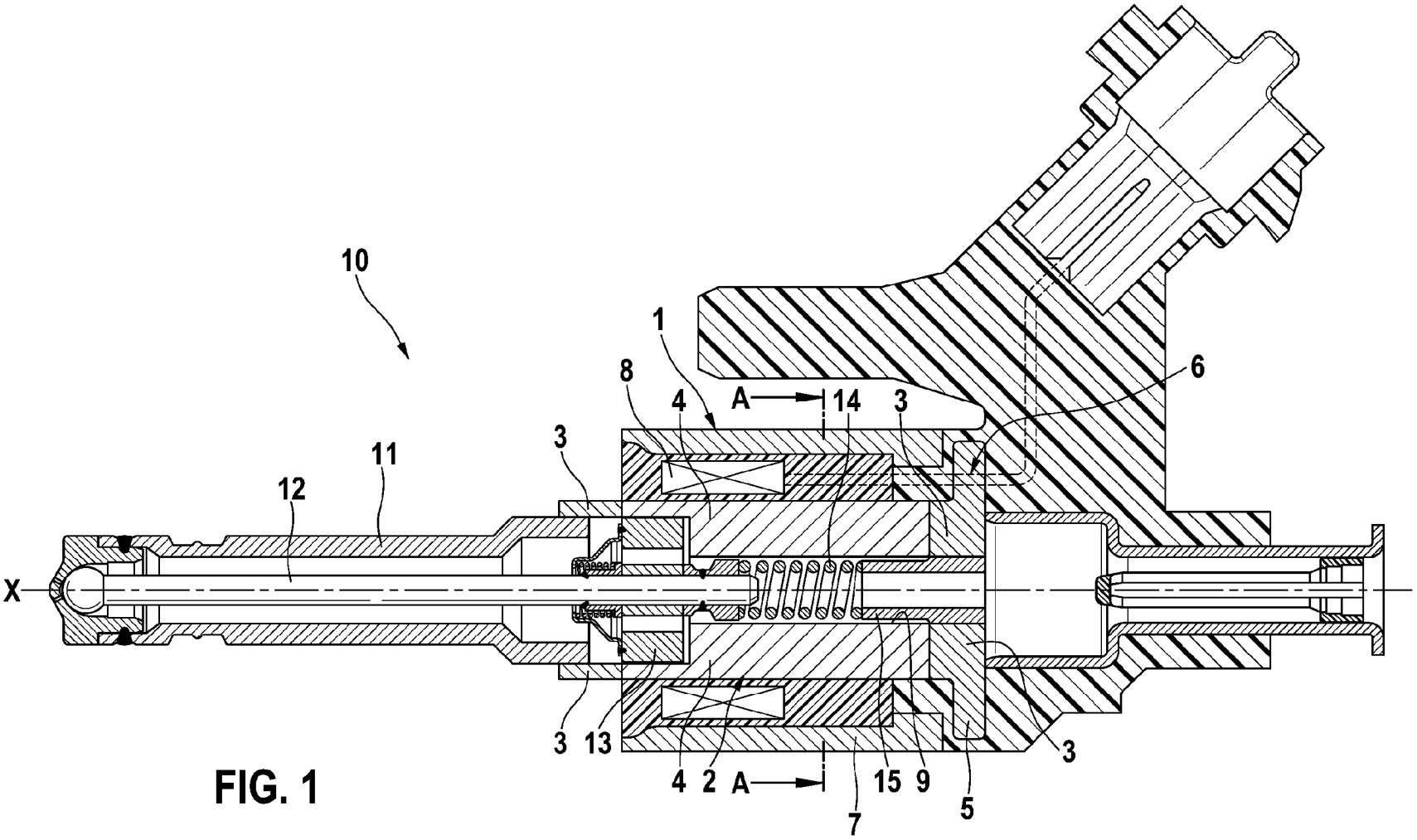
FIG. 1 shows a schematic sectional view of a fuel injector having a magnetic actuator according to a first preferred exemplary embodiment of the present invention.
Figure 2:
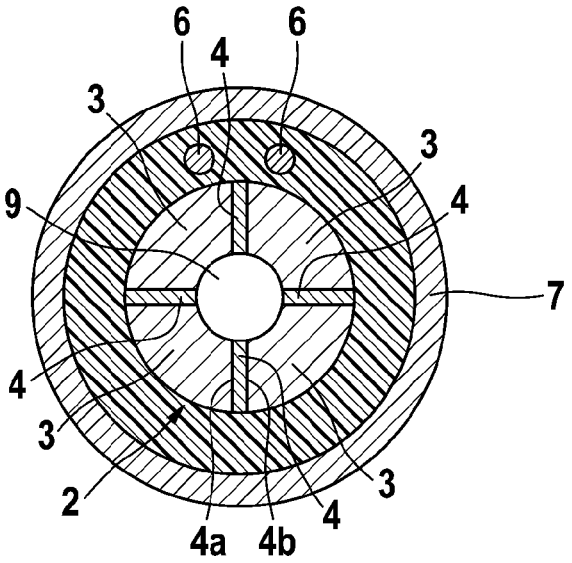
FIG. 2 shows a sectional view along a plane A-A of the fuel injector of FIG. 1.

FIG. 1 shows a schematic sectional representation of a fuel injector 10 for controlling a fluid according to a first exemplary embodiment of the present invention. Fuel injector 10 includes a valve housing 11, in whose interior a valve needle 12 opening inwards is provided, having a restoring element 14 that is situated on it and a pressure piece 15. Moreover, a magnetic actuator 1 is provided, which includes a magnet armature 13 that is fixed on valve needle 12, as well as a pole body 2 and a coil 8, which are situated coaxially with a center axis X in a coil housing 7 in the radial direction between the coil housing 7 and the pole body 2. Pole body 2 has a feed-through opening 9, in which valve needle 12 is guided together with restoring element 14 and pressure piece 15. Pole body 2 also has a flange 5 running radially outwards, in which a lead-through 6 is developed for the electrical contacting of coil 8. As may also be seen in FIG. 1, the axial extension of pole body 2 is developed to be greater than the axial extension of coil housing 7. The end of pole body 2 facing the injection side is guided between coil 8 and magnetic actuator 13 out of coil housing 7 and is fastened on the outside on valve housing 11. When fuel injector 1 is operated, valve needle 12 is moved towards pole body 2 in the direction of center axis X, and upon switching off, is guided back into its initial position by restoring element 14.

Pole body 2 has two nonmagnetic regions 4 that are visible in the illustration in FIG. 1, as well as magnetic regions 3 at its ends facing, and facing away from, the injection side. As may be seen in FIG. 2, which illustrates a sectional representation along a plane A-A of FIG. 1, in this first exemplary embodiment four nonmagnetic regions 4 are provided which are situated at an angular distance of 90° on pole body 2 and which isolate the four magnetic regions 3 from one another. The nonmagnetic regions 4 are bordered by respectively two parallel side areas 4*a*, 4*b* and in each case a convexly developed outer end face and a concave inner end face. In this connection, the convex curvature of the outer end face corresponds to the outer diameter of pole body 2 and the concave curvature of the inner end face to the outer diameter of through hole 9. Alternatively to the first exemplary embodiment shown here, the number of the magnetic and the nonmagnetic regions 3, 4 may be varied according to a desired functionality of the magnetic actuator, but at least two nonmagnetic regions should be present or provided.

The production of pole body 2 of magnetic actuator 1 preferably takes place by a two-component metal powder injection molding process. In this context, alternatively, either first the nonmagnetic regions 4 may be injection molded of nonmagnetic material and after that, the magnetic regions 3 of magnetic material, or in the opposite sequence, and connected to one another in one production step in a continuous material time-efficiently and cost-effectively. Because of the very good reproducibility of the method, one is able to achieve only slight variation of the magnetic values of pole body 2 of magnetic actuator 1.

Because of the production method according to the present invention, one-piece pole bodies 2 are able to be produced for the magnetic actuators 1 according to the present invention, even if they have complex contours, particularly economically in a single production process, which cannot be done using conventional production method. Furthermore, a component integration of coil housing 7 is possible, whereby assembly processes and connecting processes, and the test steps connected with these, are able to be saved in the production. According to the achievable reduced eddy current losses, in particular, the dynamics response desired and required in high-pressure fuel injectors is clearly improved, which contributes to a considerably improved fuel consumption and emission behavior of the engine.

Figure 3:
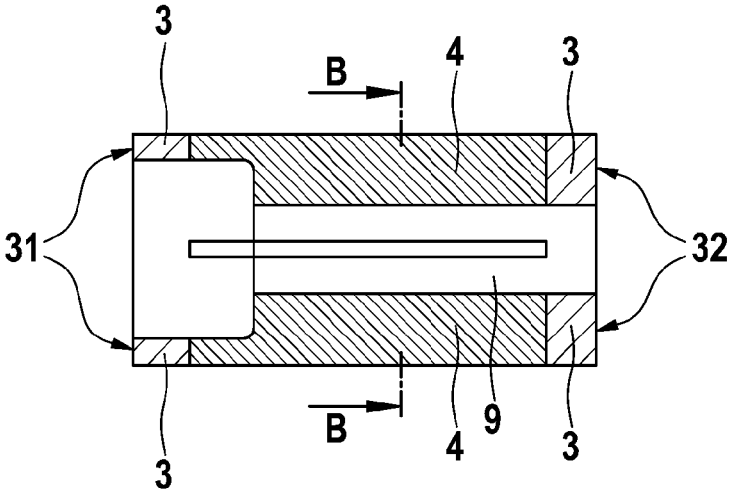
FIG. 3 shows a sectional view of the pole body according to a second preferred exemplary embodiment of the present invention.
Figure 4:
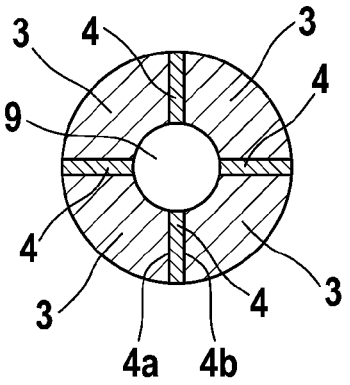
FIG. 4 shows a sectional view along a plane B-B of the pole body of FIG. 3.

With reference to FIGS. 3 to 4, a magnetic actuator according to a second preferred exemplary embodiment of the present invention is described in detail below. Same or functionally equivalent parts are designated by the same reference numerals as in the first exemplary embodiment.

By contrast to the first exemplary embodiment described before, the second exemplary embodiment has a pole body 2 without an integrated coil housing 7 (FIG. 3), which is also developed having four magnetic regions 3 and four nonmagnetic regions 4, which are situated alternatingly at an angular distance of 90° to one another, as is illustrated in FIG. 4 in the sectional view of plane B-B of FIG. 3. The end-faced axial ends 31, 32, in this case, as in the first exemplary embodiment shown in FIG. 1, each show a completely encircling magnetic region 3.

What is claimed is:

1. A magnetic actuator, comprising:

at least one magnetic region;

at least one nonmagnetic region that provides a magnetic isolation of the magnetic region;

wherein:

the at least one magnetic region and the at least one nonmagnetic region are connected using a two-component metal powder injection molding process, such that the at least one magnetic region and the at least one nonmagnetic region form a single continuous integrated pole body;

the at least one nonmagnetic region is arranged alternatingly to the at least one magnetic region in a circumferential direction about the pole body;

the at least one magnetic region includes at least two magnetic regions and the at least one nonmagnetic region includes at least two nonmagnetic regions, the nonmagnetic regions providing an isolation of the magnetic regions from one another, and wherein all the magnetic regions and all the nonmagnetic regions of the pole body together form the single continuous integrated pole body; and a flange extending radially outwards from the pole body; and at least one of:

(a) a lead-through for an electric contacting is situated in the flange; and (b) the pole body is surrounded by a coil housing along at least a portion of an extent of the pole body along an axial direction of the pole body, and a coil is situated in a radial direction between the coil housing and the pole body.

2. The magnetic actuator as recited in claim 1, wherein the pole body is surrounded by the coil housing along at least a portion of the extent of the pole body along the axial direction of the pole body, and the coil is situated in the radial direction between the coil housing and the pole body.

3. The magnetic actuator as recited in claim 2, wherein an axial extension of the pole body is greater than an axial extension of the coil housing.

4. The magnetic actuator as recited in claim 3, wherein the pole body has a central through hole.

5. The magnetic actuator as recited in claim 2, wherein the nonmagnetic regions are smaller than the magnetic regions by a factor, the factor being a value in the range of 4 to 6.

6. The magnetic actuator as recited in claim 2, wherein the nonmagnetic regions are smaller than the magnetic regions by a factor of 5.

7. The magnetic actuator as recited in claim 2, wherein each of at least one of the nonmagnetic regions includes two faces that are radially opposite each other and that are parallel to each other.

8. The magnetic actuator as recited in claim 2, wherein two lateral areas of the nonmagnetic regions of the pole body are configured parallel to each other.

9. The magnetic actuator as recited in claim 8, wherein the pole body has four magnetic regions and four nonmagnetic regions.

10. The magnetic actuator as recited in claim 9, wherein the pole body has a symmetrical configuration.

11. The magnetic actuator as recited in claim 2, wherein the pole body includes a magnetic region that extends continuously circumferentially about the pole body at at least one axial end of the pole body.

12. The magnetic actuator as recited in claim 2, wherein the pole body includes a respective magnetic region that extends continuously circumferentially about the pole body at each of the axial ends of the pole body.

13. The magnetic actuator as recited in claim 1, wherein the lead-through for the electric contacting is situated in the flange.

14. The magnetic actuator as recited in claim 13, wherein two lateral areas of the nonmagnetic regions of the pole body are configured parallel to each other.

15. The magnetic actuator as recited in claim 14, wherein the pole body has four magnetic regions and four nonmagnetic regions.

16. The magnetic actuator as recited in claim 15, wherein the pole body has a symmetrical configuration.

17. The magnetic actuator as recited in claim 13, wherein the nonmagnetic regions are smaller than the magnetic regions by a factor, the factor being a value in the range of 4 to 6.

18. The magnetic actuator as recited in claim 13, wherein the nonmagnetic regions are smaller than the magnetic regions by a factor of 5.

19. The magnetic actuator as recited in claim 13, wherein each of at least one of the nonmagnetic regions includes two faces that are radially opposite each other and that are parallel to each other.

20. The magnetic actuator as recited in claim 13, wherein the pole body includes a magnetic region that extends continuously circumferentially about the pole body at at least one axial end of the pole body.

21. The magnetic actuator as recited in claim 13, wherein the pole body includes a respective magnetic region that extends continuously circumferentially about the pole body at each of the axial ends of the pole body.

22. A method for producing a one-piece pole body for a magnetic actuator, comprising:

providing a magnetic material and a nonmagnetic material; and producing nonmagnetic regions and magnetic regions of the one-piece pole body using a two-component metal powder injection molding process such that the nonmagnetic regions and the magnetic regions are connected to one another in a continuous material manner, the nonmagnetic regions being arranged alternatingly to the magnetic regions in a circumferential direction about the pole body;

wherein at least one of:

the pole body extends distally from a first axial position at which the pole body is radially interior to a coil housing to a distal end of the pole body that is at a second axial position, the second axial position being beyond a distal end of the coil housing, the distal end of the pole body surrounding a proximal end of a valve needle housing, the entire valve needle housing being distal to the distal end of the coil housing; and a flange extends radially outwards from the pole body, the nonmagnetic regions provide an isolation of the magnetic regions from one another, all the magnetic regions and all the nonmagnetic regions of the pole body together form the single continuous integrated pole body, and at least one of (a) a lead-through for an electric contacting is situated in the flange and (b) the pole body is surrounded by a coil housing along at least a portion of an extent of the pole body along an axial direction of the pole body, and a coil is situated in a radial direction between the coil housing and the pole body.

23. A magnetic actuator, comprising:

at least one magnetic region; and at least one nonmagnetic region that provides a magnetic isolation of the magnetic region;

wherein:

the at least one magnetic region and the at least one nonmagnetic region are connected using a two-component metal powder injection molding process, such that the at least one magnetic region and the at least one nonmagnetic region form a single continuous integrated pole body;

the at least one nonmagnetic region is arranged alternatingly to the at least one magnetic region in a circumferential direction about the pole body; and the pole body extends distally from a first axial position at which the pole body is radially interior to a coil housing to a distal end of the pole body that is at a second axial position, the second axial position being beyond a distal end of the coil housing, the distal end of the pole body surrounding a proximal end of a valve needle housing, the entire valve needle housing being distal to the distal end of the coil housing.

24. The magnetic actuator as recited in claim 23, wherein the pole body includes a magnetic region that extends continuously circumferentially about the pole body at at least one axial end of the pole body.

25. The magnetic actuator as recited in claim 23, wherein the pole body includes a respective magnetic region that extends continuously circumferentially about the pole body at each of the axial ends of the pole body.

26. The magnetic actuator as recited in claim 23, wherein the at least one magnetic region includes at least two magnetic regions and the at least one nonmagnetic region includes at least two nonmagnetic regions, the nonmagnetic regions providing an isolation of the magnetic regions from one another, and wherein all the magnetic regions and all the nonmagnetic regions of the pole body together form the single continuous integrated pole body.

27. The magnetic actuator as recited in claim 26, further comprising a flange extending radially outwards from the pole body.

28. The magnetic actuator as recited in claim 27, wherein a lead-through for an electric contacting is situated in the flange.

29. The magnetic actuator as recited in claim 27, wherein the pole body is surrounded by a coil housing along at least a portion of an extent of the pole body along an axial direction of the pole body, and wherein a coil is situated in a radial direction between the coil housing and the pole body.

30. The magnetic actuator as recited in claim 29, wherein an axial extension of the pole body is greater than an axial extension of the coil housing.

31. The magnetic actuator as recited in claim 30, wherein the pole body has a central through hole.

32. The magnetic actuator as recited in claim 26, wherein two lateral areas of the nonmagnetic regions of the pole body are configured parallel to each other.

33. The magnetic actuator as recited in claim 32, wherein the pole body has four magnetic regions and four nonmagnetic regions.

34. The magnetic actuator as recited in claim 33, wherein the pole body has a symmetrical configuration.

35. The magnetic actuator as recited in claim 23, wherein the nonmagnetic regions are smaller than the magnetic regions by a factor, the factor being a value in the range of 4 to 6.

36. The magnetic actuator as recited in claim 23, wherein the nonmagnetic regions are smaller than the magnetic regions by a factor of 5.

37. The magnetic actuator as recited in claim 23, wherein each of at least one of the nonmagnetic regions includes two faces that are radially opposite each other and that are parallel to each other.

* * * * *